United States Patent [19]

Haining

[11] Patent Number: 4,956,218

[45] Date of Patent: Sep. 11, 1990

[54] FIRE PROTECTION BLANKET

[76] Inventor: Michael L. Haining, 6731 Ashmore, Houston, Tex. 77069

[21] Appl. No.: 395,075

[22] Filed: Aug. 17, 1989

[51] Int. Cl.[5] ..... A62C 7/00

[52] U.S. Cl. ..... 428/102; 428/193; 428/920; 428/921; 169/50

[58] Field of Search ..... 428/102, 193, 920, 921; 169/50, 49, 48; 52/3, 4

[56] References Cited

U.S. PATENT DOCUMENTS 4,619,553 10/1986 Fischer ..... 169/50

4,650,002 3/1987 Webster, Jr. ..... 169/50

*Primary Examiner*—Alexander S. Thomas

*Attorney, Agent, or Firm*—Richard L. Moseley

[57] ABSTRACT

A fire protection blanket is comprised of a flexible layered blanket having two layers of fire resistant material sandwiched about an insulating layer. Handling straps are arrayed on at least one surface in a tic-tac-toe pattern and secured in several places along the straps to provide a plurality of grasping loops.

9 Claims, 1 Drawing Sheet

FIRE PROTECTION BLANKET

BACKGROUND OF THE INVENTION

Fire blankets are normally considered to be fire extinguishing devices and as such there are several examples in the art. U.S. Pat. Nos. 2,720,269; 2,340,370; 3,828,856; 4,597,450; and 4,650,002 all disclose blankets which are useful for smothering fires. Additionally U.S. Pat. No. 4,619,553 discloses a high temperature containment boom which may be used to contain a fire during in situ burning of spilled oil.

A fire shield is disclosed in U.S. Pat. No. 4,269,901 which is used to shield a person from a fire while approaching the fire for extinguishing purposes. The shield disclosed therein comprises a flexible sheet of heat resistant material with stiffening members and handles. Some of the fire blankets listed above may also be used as a shield when approaching a fire. See, for example, U.S. Pat. Nos. 4,597,450 and 4,650,002.

One of the most common causes of death in home fires is from entrapment and subsequent suffocation. While adults may have the presents of mind to escape out of bedroom window, often children need to be assisted in their escape. However due to separation, parents may not be able to reach children during a fire. Another problem has arisen in a security conscious society with burglar bars now blocking window exits. Inhabitants are thus left with doors as the only means of exit, the access to which may be blocked by flames. Additionally such deaths occur at night with darkness preventing quick access to what fire protection equipment is available.

There is thus a need for a readily accessible fire protection shield. Such shield should be easily stored beneath a bed and be adaptable for use by almost any sized person. Additionally, the shield should be easily handled.

SUMMARY OF THE INVENTION

In light of the above considerations the inventor has devised a fire protection blanket or structure which may be stored underneath a bed for ready access. Additionally, the inventor has provided a symmetrical structure with a plurality of handles so that the blanket may be grasped from any position and used without regard to orientation.

The fire protection blanket or structure is comprised of a flexible layered blanket having two layers of fire resistant material such as NOMEX, a flame resistant aramid fabric, sandwiched about an insulating layer such as cotton batting. On at least one surface two pluralities of handling straps are arranged in any array as in a tic-tac-toe pattern. The edges of the three layers are secured together as with stitching, such securing means also serving to secure the ends of the handling straps. Additionally each strap is secured, as with stitching through all three layers, at intermediate points to provide a plurality of grasping loops. In addition to providing the grasping loops in the handling straps, the stitching also serves as quilting to prevent movement of the cotton batting layer between the two outer layers.

The fire blanket is preferably six feet square and each plurality of straps contains at least two straps with each of the straps spaced one and one-half feet from an edge. Each strap should be secured to the surface at one foot intervals providing twenty four grasping loops. If the straps are provided on one surface only, then the blanket should be folded so that the straps are exposed. If a fire is detected a person may thus quickly reach under the bed and grasp the blanket by a loop and pull it over his head in a crouched position and exit through the fire if necessary to safety. Preferably there should be one blanket per person per bed, however a six foot square blanket could be used to protect one adult and one small child.

DETAILED DESCRIPTION OF THE PREFERRED EMBODIMENT

Figure 1:
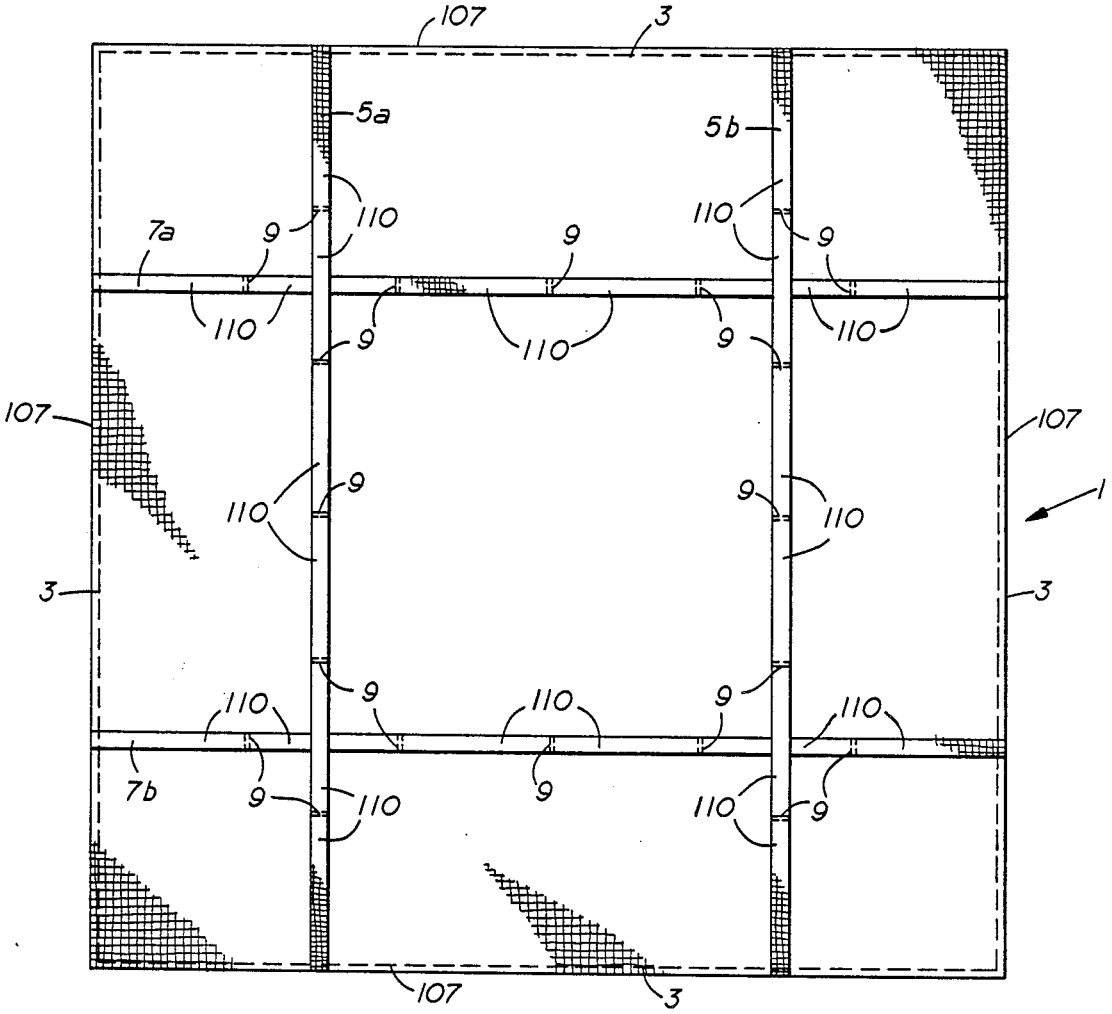
FIG. 1 is a plan view of one surface of the fire protection structure of the present invention.

For a detailed description of the preferred embodiments the reader is directed to the accompanying figures in which like components are given like reference numerals.

As illustrated in FIG. 1 the fire protection structure 1 is shown to comprises a generally square layered blanket 102. First and second pluralities of straps, 5 and 7, are shown to comprise individual straps *5a*, *5b*, *7a*, and *7b* respectively. The straps are disposed in a crossing pattern on at least one surface of the blanket similar to a tic-tac-toe board. The blanket is preferably six feet square and the straps are spaced one and onehalf feet from each edge leaving a three foot square in the middle. Stitching about the edges 107 servers to hold the layers together and to secure the ends of the straps to the surface. Additionally each strap is secured to the surface at one foot intervals by stitching 9 which define grasping loops 110.

Figure 2:
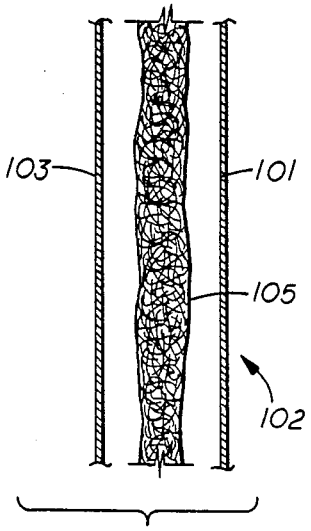
FIG. 2 is an exploded end sectional view of the blanket showing the laminar construction.

Referring now to FIG. 2 the laminar construction of the blanket 102 is shown. First and second layers 101 and 103 are of fire resistant material such as NOMEX. Sandwiched between the first and second layers is an insulating layer 105, preferably of cotton batting. As noted above the three are all secured together by stitching completely around the edges 107. Other suitable securing means might include staples or bonding agents such as a glue.

Figure 3:
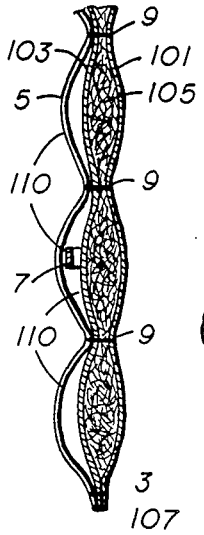
FIG. 3 is an end sectional view of the fire protection structure.

Referring now to FIG. 3 and end sectional view including one edge is shown. The layer securing means, such as stitching is indicated at 3. One strap, as of plurality 5, is shown secured at the edge 107 by securing means 3. Additionally at the intermediate points the strap is secure as by stitching 9 through the layers to prevent movement of the batting between the layers. If the insulating layer were one continuous sheet, such intermediate securing would not necessarily have to pass through all three layers. Since the straps are spaced one and one-half feet from the edge and the intermediate points are spaced one foot apart, the straps are not secured where they cross. The spacing of the straps near the edge serves three purposes: (1) quick grasping of the blanket; (2) control over the edges; and (3) protection for the hands.

Figure 4:
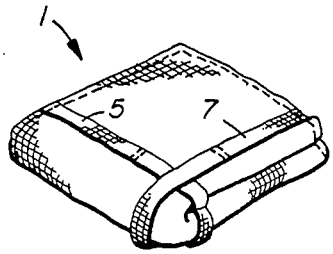
FIG. 4 is an illustration of the use of the fire protection structure.

FIG. 4 shows the structure folded for storage. If only one surface is equipped with the handling straps, it should be folded to expose the straps for quick grasping.

Figure 5:
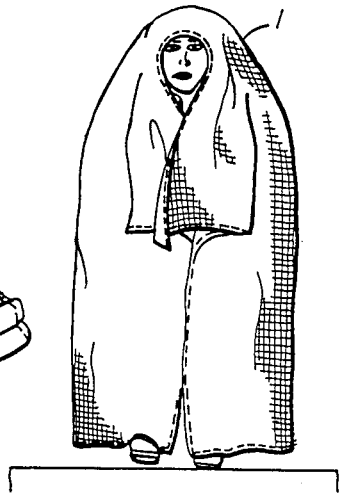

FIG. 5 shows the use of the structure. The person may grasp any two of the loops 110 and arrange the blanket over his head. The spacing of the straps ensures that the users hands are protected.

The foregoing description of the invention has been directed to a particular preferred embodiment of the present invention for purposes of explanation and illustration. It will be apparent to those skilled in the art that many modifications and changes in the apparatus may be made without departing from the scope and spirit of the invention. It is, therefore, intended that the following claims cover all equivalent modifications and variations as fall within the scope of the invention as defined by the claims.

What is claimed is:

1. A fire protection structure comprising:

(a) a flexible blanket of laminar construction having first and second fire resistant layers and a third insulating layer between said first and second layers;

(b) first means for securing said layers together;

(c) first and second pluralities of straps disposed in an array on at least one surface of said blanket: and (d) second means for securing each of said straps of said pluralities of straps to said surface.

2. The fire protection structure of claim 1 wherein said blanket is in substantially the shape of a square.

3. The fire protection structure of claim 2 wherein said square is substantially six feet on each side.

4. The fire protection structure of claim 3 wherein second means for securing includes means through all of said layers to prevent movement of said layers in relation to one another.

5. The fire protection structure of claim 4 wherein said second securing means comprises stitching sewn through said straps and through said layers.

6. The fire protection structure of claim 1 wherein said array comprises two straps in each plurality of straps and said pluralities are mutually perpendicular.

7. The fire protection structure of claim 6 wherein each strap is secured by said second securing means to said surface at a plurality of evenly spaced points to provide a plurality of loops along the length of each of said straps.

8. The fire protection structure of claim 7 wherein said second securing means comprises stitching sewn through said straps and said layers.

9. The fire protection structure of claim 1 wherein said first securing means comprises stitching sewn through said layers about the edges of said blanket and said second securing means comprises stitching sewn through said straps and said layers.

* * * * *